US005632108A

United States Patent [19]

Ruger et al.

[11] Patent Number: 5,632,108

[45] Date of Patent: May 27, 1997

[54] METHOD OF MANUFACTURING OF MOLDED FIREARM PART WITH INSERT AND PART

[75] Inventors: William B. Ruger, Croydon, N.H.; James McGarry, Prescott, Ariz.

[73] Assignee: Sturm, Ruger & Company, Inc., Southport, Conn.

[21] Appl. No.: 554,615

[22] Filed: Nov. 6, 1995

Related U.S. Application Data

[63] Continuation of Ser. No. 233,177, Apr. 26, 1994, abandoned.

[51] Int. Cl.[6] ..... F41C 23/10

[52] U.S. Cl. ..... 42/1.01; 42/71.02; 42/7

[58] Field of Search ..... 42/1.01, 71.02, 42/7, 90, 106, 85

[56] References Cited

U.S. PATENT DOCUMENTS

| | | | |
|---|---|---|---|
| 2,308,627 | 1/1943 | Rickenbacher | 42/71.02 |
| 2,544,150 | 3/1951 | Franklin | 42/90 |
| 3,672,084 | 6/1972 | Pachmayr . | |
| 4,043,066 | 8/1977 | Pachmayr et al. | 42/71.02 |
| 4,132,024 | 1/1979 | Pachmayr et al. | 42/74 |
| 4,221,066 | 9/1980 | Hillberg | 42/71.02 |
| 4,359,833 | 11/1982 | Pachmayr et al. . | |
| 4,378,651 | 4/1983 | Pachmayr et al. . | |
| 4,463,654 | 8/1984 | Barnes et al. | 42/74 |
| 4,486,966 | 12/1984 | Seehase | 42/1.01 |
| 4,769,938 | 9/1988 | Chestnut et al. | 42/76.02 |
| 4,833,812 | 5/1989 | Farrar | 42/71.02 |
| 4,936,036 | 6/1990 | Sniezak et al. | 42/71.02 |
| 4,999,941 | 3/1991 | Farrar | 42/71.02 |
| 5,168,648 | 12/1992 | Brandl et al. | 42/50 |

FOREIGN PATENT DOCUMENTS

| | | | |
|---|---|---|---|
| 326373 | 6/1934 | Germany | 42/71.02 |
| 765502 | 1/1957 | United Kingdom . | |
| 840041 | 7/1960 | United Kingdom . | |

*Primary Examiner*—Stephen M. Johnson
*Attorney, Agent, or Firm*—Pennie & Edmonds

[57] ABSTRACT

A method of manufacturing a firearm part and the part so manufactured in which the part is molded in a mold having secured therein an insert unit and after demolding a portion of such insert unit is removed to create an identification surface.

3 Claims, 2 Drawing Sheets

METHOD OF MANUFACTURING OF MOLDED FIREARM PART WITH INSERT AND PART

This is a continuation of application Ser. No. 08/233,177, filed Apr. 26, 1994, now abandoned.

BACKGROUND OF THE INVENTION

Various firearm parts including frames have in the past been made by molding using non-metalic substances. Serial numbers and other identification have been affixed to certain of such molded parts.

SUMMARY OF THE INVENTION

Broadly, the present invention comprises a method of manufacturing a firearm part using a multipiece mold with an insert unit which unit is integrally molded into such firearm part. A portion of the insert unit is anchored in a mold recess during molding which portion is thereafter removed.

It is a feature that the part so manufactured can be readily marked with a serial number or other identification and that the insert unit is composed of material denser than the molded material.

DESCRIPTION OF THE PREFERRED EMBODIMENT

Figure 1:
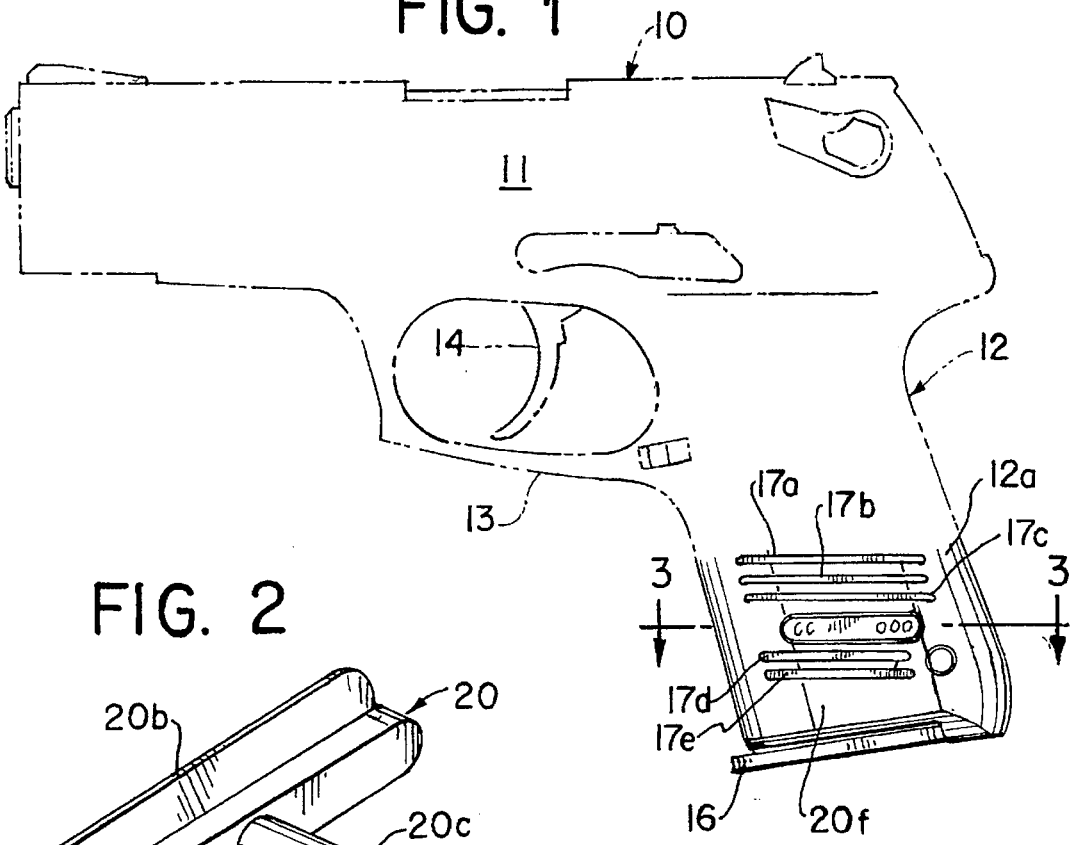
FIG. 1 is a side elevational view of a pistol having a molded frame with an insert therein.
Figure 2:
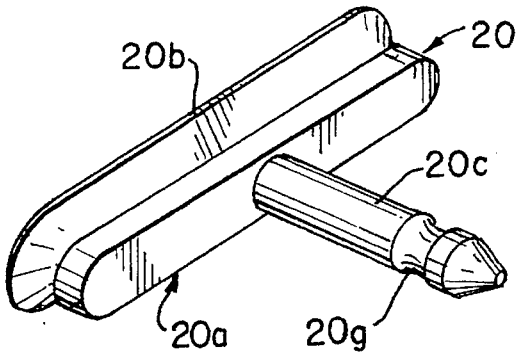
FIG. 2 is a perspective view of an insert unit prior to and during molding.

In FIGS. 1–5, firearm 10 includes slide 11, molded frame 12 including grip frame portion 12*a*, trigger guard 13, trigger 14 and magazine 16. Horizontal grip recesses 17*a*–*e* are also shown in FIG. 1. Insert face plate 20*f* is seen protruding slightly beyond the frame mold grip portion 12*a* which face 20*f* carries the pistol serial number. Frame 12 is made of moldable material preferably a nylon-based plastic.

Figure 4:
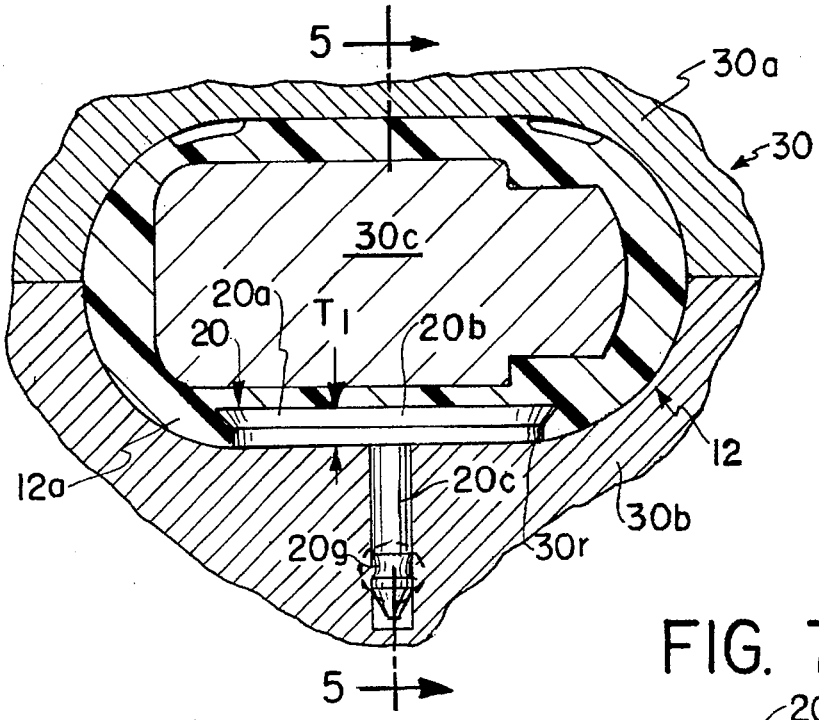
FIG. 4 is a sectional view of a pistol frame mold with insert unit formed therein.
Figure 5:
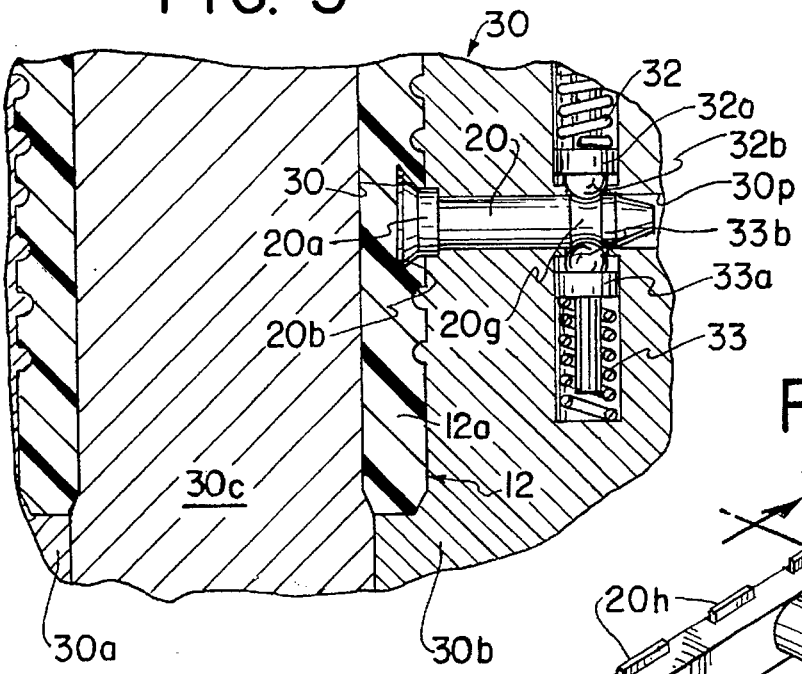
FIG. 5 is a sectional view along line 5—5 of FIG. 4.

Turning to pistol frame mold as shown in FIGS. 4 and 5, mold 30 includes upper mold half 30*a*, lower mold half 30*b* and mold core 30*c*. Mold half 30*b* also includes a mold recess 30*r* for accepting insert unit 20. Insert unit 20 includes insert body 20*a*, insert skirt 20*b* and insert prong 20*c*. Recess 30*r* functions to locate unit 20 therein and detent units 32, 33 described below apply forces to hold unit 20 in recess 30*r*. Insert unit 20 is made of a material harder than the molded material preferably a metallic material. Prong 20*c* is fitted in lower mold passageway 30*p*. Prong 20*c* has circumferential groove 20*g* which together with spring-loaded opposed detent units 32, 33 hold insert unit 20 in place prior to molten plastic introduction, during introduction and during solidification of the plastic which forms frame part 12. Each detent unit 32, 33 includes spring-loaded plunger 32*a*, 33*a* which urge balls 32*b*, 33*b* into groove 20*g*. Detent units 32, 33 grip insert prong 20*c* and hold it to maintain unit 20 in mold recess 30*r* during the molding operation.

After molding is complete, frame 12 including engaged insert unit 20, is taken out of mold 30 by opening mold 30 and applying sufficient force to overcome spring detents 32, 33 to free prong 20*c*.

Figure 3:
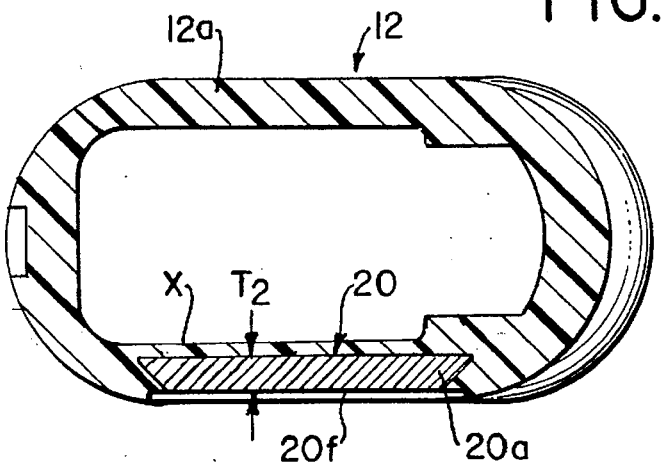
FIG. 3 is a sectional view along line 3—3 of FIG. 1.

Following such molding and demolding steps, insert prong 20*c* is removed by cutting, abrading or other suitable material removable step and thereafter insert body 20*a* is ground down or otherwise reduced in thickness from $T_1$ to $T_2$ (see FIGS. 3 and 4). As reduced, the outer surface of body 30*b* has planar face 20*f*. The pistol serial number is then placed on or in face 20*f*.

Figure 7:
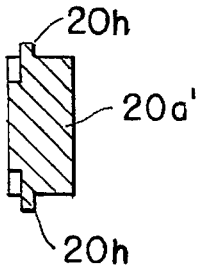
FIG. 7 is a sectional view along line 7—7 of FIG. 6.
Figure 6:
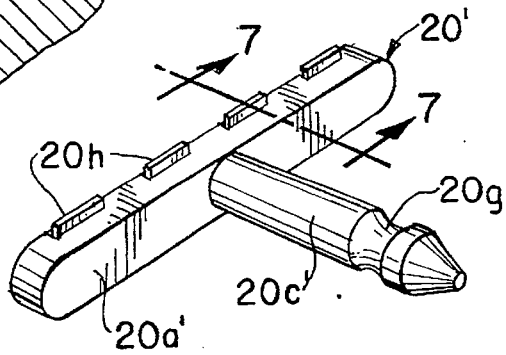
FIG. 6 is a perspective view of an alternative insert unit.

FIGS. 6 and 7 illustrate an alternative embodiment in which unit 20' includes insert body 20*a'* includes body fins 20*h* for further anchoring insert 20' in frame 12.

We claim:

1. A firearm part comprising a molded portion having a first hardness and having an exterior surface, and an opening in said exterior surface and an insert portion having a body of a second hardness which second hardness is harder than the first hardness molded into and integral with such molded portion, said insert portion including an elongated body surface positioned in said molded portion opening and being substantially the size of said opening and the area of said body surface being substantially flat and visible through said opening;

said insert portion being made of a material for receiving a serial number, and a serial number on said insert portion.

2. The firearm part of claim 1 in which the molded portion is molded of plastic material and the insert portion is metallic.

3. The firearm part of claim 2 in which the part is a pistol frame.

* * * * *